US005871420A

United States Patent [19]

Arasmith

[11] Patent Number: 5,871,420

[45] Date of Patent: Feb. 16, 1999

[54] SPOTTING APPARATUS FOR USE WITH GYMNASTIC EQUIPMENT

[76] Inventor: Stanley B. Arasmith, 456 Cut Off Rd., Plainville, Ga. 30733

[21] Appl. No.: 723,258

[22] Filed: Sep. 30, 1996

[51] Int. Cl.[6] ..... A63B 26/00; A63B 1/00

[52] U.S. Cl. ..... 482/23; 482/38

[58] Field of Search ..... 482/38, 23, 24, 482/34, 143, 37, 35, 908; 182/118, 129

[56] References Cited

U.S. PATENT DOCUMENTS 4,905,330 3/1990 Jacobs ..... 482/23 X

FOREIGN PATENT DOCUMENTS 936946 6/1982 U.S.S.R. .

*Primary Examiner*—Richard J. Apley
*Assistant Examiner*—Denise Pothier
*Attorney, Agent, or Firm*—Jones & Askew

[57] ABSTRACT

An spotting assistance apparatus for use in conjunction with a horizontal bar apparatus for providing support for a gymnastics spotter. The apparatus includes a pivoting support platform which is pivotable about a horizontal axis, such that the platform can be moved from a nonoperating position to an operating position. The operating positions of the pivoting support platforms can be adjusted among different operating positions.

26 Claims, 2 Drawing Sheets

SPOTTING APPARATUS FOR USE WITH GYMNASTIC EQUIPMENT

TECHNICAL FIELD

This invention relates in general to gymnastics, and particularly relates to an apparatus for providing assistance to gymnast spotters, when assisting gymnasts using a horizontal bar.

BACKGROUND OF THE INVENTION

In the field of gymnastics, an apparatus used by gymnasts is a "horizontal bar" (sometimes also referred to as a "high bar" or "crossbar"), which is essentially a horizontal bar supported at its two ends by substantially vertical support posts. A gymnast performs on the horizontal bar by grasping the horizontal bar with the hands and performing various body or "exercise" routines. Such horizontal bars may be used in a practice environment over a "pit" filled with padding (such as loose rubber foam blocks), to provide a safe landing location for the gymnast after he or she releases the horizontal bar (either intentionally or unintentionally).

As may be understood, such horizontal bars can be quite difficult to reach without some assistance, especially if a pit is used. Therefore in the prior art an apparatus has been developed for providing a movable platform to provide support for a gymnast when mounting such a horizontal bar. USSR Patent No. 936,946 (at least in its English-language translation) discloses the use of a platform 5 which appears to provide a "step", to allow a gymnast to access the horizontal bar. After the weight of the gymnast is released from the platform, the platform appears to be configured to swing out of the way, pivoting about a vertical axis under the force of a torsion spring, such that it is out of the exercise range of the gymnast, or in a "safe zone". FIG. 1 of the USSR Patent No. 936,946 illustrates the operating and nonoperating positions of the "step".

It appears that the USSR Patent No. 936,946 apparatus utilizes one of the vertical support posts 1 for what appears to be its primary means of support. It is submitted that the weight of person situated atop the platform is essentially supported by the vertical bar to which the platform is attached. Furthermore, the "vertical" nature of the pivoting appears to necessitate the use of a relatively small platform.

Some gymnastics routines may include difficult and possibly dangerous movements for the gymnast. Therefore, it is known in the art to use a "spotter", a second person positioned adjacent the horizontal bar, to assist the gymnast during his or her routines. The spotter can provide body support or other assistance during a routine. However, at times it may be difficult for the spotter to provide spotting assistance for a gymnast who is practicing moves which are out of the reach of the spotter. It appears to applicant that the USSR apparatus would not allow for the use by a spotter; instead it appears to be for use as a step by a gymnast when approaching the bar.

Although the prior art has some advantages, it may be seen that several disadvantages nevertheless exist. For example, the prior art apparatus discussed above would appear to provide a particularly "stable" configuration which would allow a "spotter" to provide spotting assistance. For example, the platform 5 of the USSR reference would appear to be too small for use by a spotter while performing duties which at times can require room for movement (the USSR "step" appears quite small) and can require a stable supporting surface (the USSR reference would appear to be relatively unstable along at least one of its vertical axes).

Therefore, it may be seen that a need exists in the art for an apparatus for use with gymnastics horizontal bar apparatuses, which facilitate the use of a "spotter" to assist one using a horizontal bar, which is safe, stable, easy to use, and provides adequate room for the spotter to stand.

SUMMARY OF THE INVENTION

The present invention overcomes deficiencies in the prior art by providing an apparatus that allows a spotter to stand on a retractable platform while providing assistance to a gymnast. The retractable platform is pivoted about a substantially horizontal axis, which provides for the use of a pivoting platform of substantial size, which is quite stable when supporting the weight of a spotter (including sideward stability), yet nevertheless can be moved from its nonoperating position to its operating position with ease. The pivoting platform is vertically adjustable relative to the horizontal bar in the preferred embodiment, which enables a spotter to select different platform heights for different spotting techniques. Finally, the apparatus provided by the invention is stable not only due to the use of a horizontal pivoting axis, but due to the fact that it is at least primarily supported by support means other than the horizontal bar apparatus.

Generally described, the present invention provides a spotting assistance apparatus for use with a gymnastics horizontal bar apparatus, the spotting apparatus providing a substantially horizontal spotter support surface for supporting a spotter thereon, the spotting assistance apparatus comprising a stationary framework and a pivotable spotter support platform pivotable about a substantially horizontal axis relative to the stationary framework from an operating position to a nonoperating position, the pivoting spotter support platform defining a spotter support surface being substantially horizontal and configured to support the weight of a spotter when the spotter support platform is in the operating position.

The present invention also provides a spotting assistance apparatus for use with a gymnastics horizontal bar apparatus, the spotting apparatus providing a substantially horizontal spotter support surface for supporting a spotter thereon, the spotting assistance apparatus comprising a stationary framework, a pivoting spotter support platform movably attached relative to the stationary framework such that the spotting platform is movable from an operating to a nonoperating position, and adjustable support means for supporting the stationary frame work at varying heights relative to the horizontal bar.

Therefore, it is an object of the present invention to provide an improved gymnastics practice apparatus.

It is a further object of the present invention to provide an improved gymnastics practice apparatus which allows for its use by a "spotter".

It is a further object of the present invention to provide a spotting apparatus having a pivotable supporting platform which is stable due to the use of a horizontal pivoting axis.

It is a further object of the present invention to provide a spotting apparatus having a relatively large pivotable supporting platform from which to spot.

It is a further object of the present invention to provide a spotting apparatus having a spotting platform which is relatively vertically adjustable relative to the height of a horizontal bar.

It is a further object of the present invention to provide a spotting apparatus for use in conjunction with a horizontal bar assembly which is substantially free-standing with respect to the horizontal bar.

It is a further object of the present invention to provide a gymnastic spotting apparatus which is easy to use.

It is a further object of the present invention to provide a gymnastic spotting apparatus which is easy to operate.

It is a further object of the present invention to provide a gymnastic spotting apparatus which is easy to construct.

It is a further object of the present invention to provide a gymnastic spotting apparatus which is cost-effective to manufacture.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Reference is now made to the drawings, in which like numerals designate like elements throughout the several views.

Outline

Figure 1:
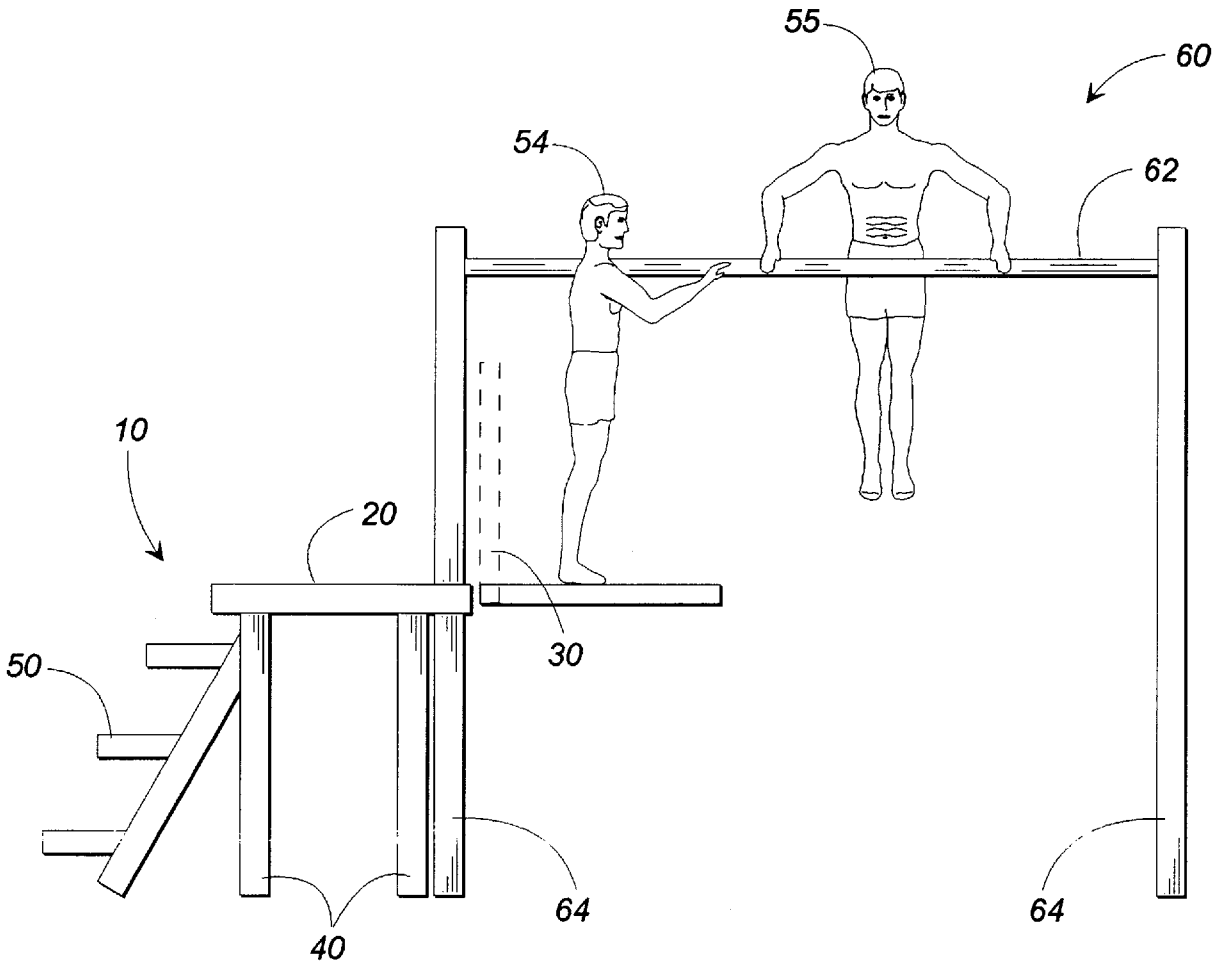
FIG. 1 is a side view of a spotting apparatus 10 used in conjunction with a horizontal bar assembly. A spotting platform 30 is shown in dotted line in its operating position, and in solid line with a spotter thereon in its "operating" position with his feet "square" on the platform.

Referring now to FIG. 1, a spotting apparatus 10 according to the present invention includes a stationary access platform 20 defining an upwardly-directed supporting surface 21, a pivoting, "spotting" platform 30, four adjustable support posts 40, and access stairs 50. The apparatus 10 is configured for use in conjunction with a horizontal bar assembly 60 including a horizontal bar 62 and two upstanding vertical end posts 64, located on each end of the horizontal bar 62 and which provide support for the bar 62 above a floor surface of a pit 100. Generally described, operation of the apparatus 10 is achieved by pivoting the self-retracting pivoting spotting platform 30 defining an upwardly-directed supporting surface 21 to its generally horizontal configuration shown in solid line in FIGS. 1 and 2, standing on the platform 30 and providing the assistance of a spotter to a gymnast performing on the horizontal bar.

The Stationary Frame

Figure 2:
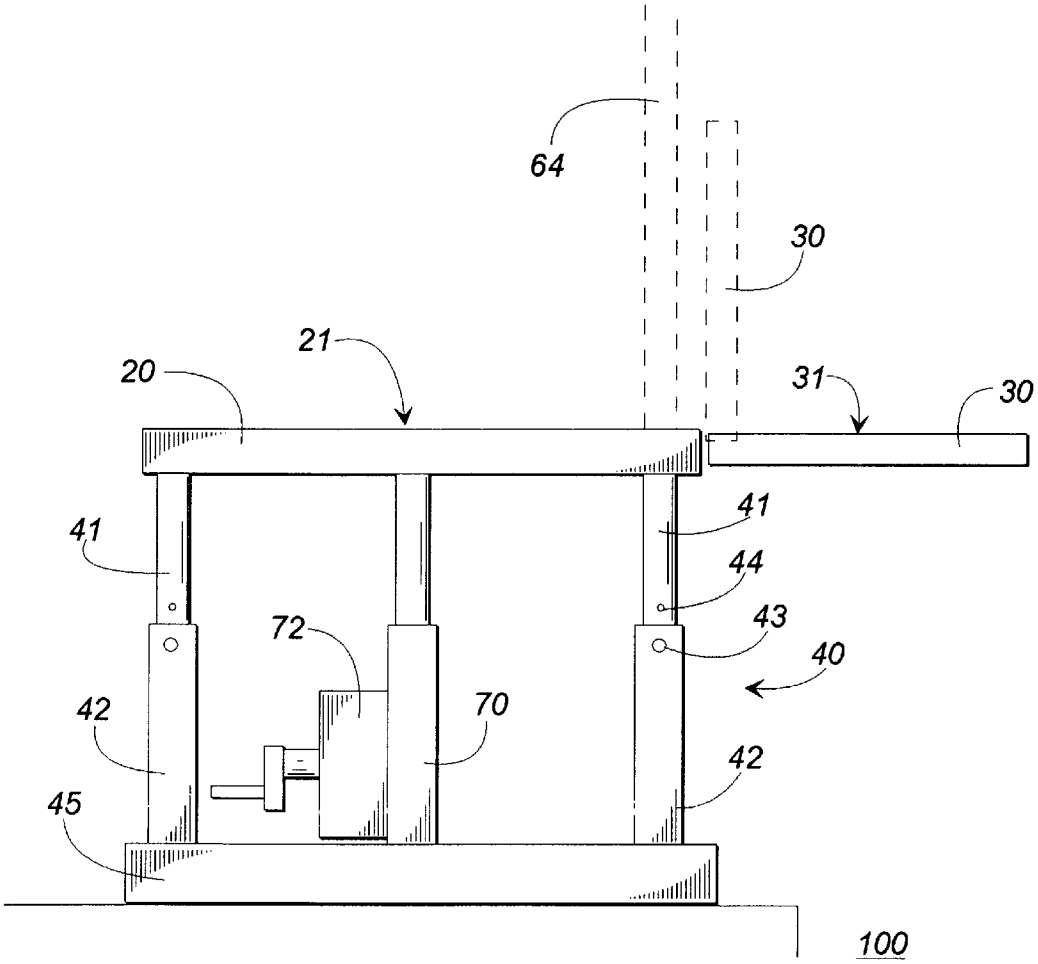
FIG. 2 is a closer view of the apparatus 10 of the invention, with a vertical support post of the horizontal bar assembly being shown in solid line. As in FIG. 1, a spotting platform 30 is shown in dotted line in its operating position, and in dotted line with a spotter thereon in its "operating" position.

Referring now also to FIG. 2, the stationary access platform 20 is substantially rigid in its construction, and is supported at its four corners by four adjustable support posts 40, which are themselves supported by a base frame member 45. Each of the four support posts includes a corresponding upper end 41 and a lower end 42, which can telescope relative to each other when unlocked as discussed below. Each of the upper ends 41 is attached relative to the stationary access platform 20, and each of the lower ends 41 is attached relative to the base frame member 45, which is fixed relative to the floor.

Although each of the adjustable support posts 40 includes a telescoping feature allowing them to be adjusted along their lengths, they can be "locked" at a certain length. This locking is provided by the use of a locking pin 43 associated with each post 40 (shown only in FIG. 2) which can be placed in a horizontally-oriented hole in the upper end of each of the lower ends 42 and also through one of several holes such as 44 in the upper ends 41 of the support posts 40. Therefore, it can be seen that the pins can be removed and inserted to selectively lock the two members 41, 42 together. While the pins are out, the two members 41, 42 can be moved relative to each other to provide one of possibly several discrete lengths for the associated support posts. This allows the height of the stationary access platform ("stationary" defined as during use) to be selectively adjusted within a number of discrete heights. However, it should be understood that other adjustment configurations could be used without departing from the spirit and scope of the present invention, such as configurations which allow for adjustment of the platform height continuously along a range of heights, with an infinite number of heights being allowable within the range.

The Pivoting Platform

The "spotting" platform 30 is substantially rectangular in one embodiment according to the present invention, with a horizontal-axis hinge configured to allow the platform 30 to pivot about a substantially horizontal axis, such that the pivoting platform can be pivoted from an "up" (nonoperating) position shown in dotted line in FIGS. 1 and 2 to a "down" configuration shown in solid line in FIGS. 1 and 2.

The spotting platform 30 defines a substantially planar, rectangular supporting surface 31 which is upwardly-directed in its operating position and suitable for supporting a human spotter such that said spotter can place his or her feet "square" on said platform and can stand in a normal standing position facing along an axis parallel to said long axis of said horizontal bar while performing said spotting duties. It may be said that the spotter support platform has a first dimension along an axis which is substantially perpendicular to the longitudinal axis of said horizontal bar and a second dimension substantially parallel to said longitudinal axis of said horizontal bar, the first dimension being longer than said second dimension.

The spotting platform is typically moved to its operating position by a user placing his or her foot atop or against it, pushing the platform down to its operating position, and then standing on it. When the user steps off the platform 30, it self-retracts to its nonoperating position. This self-retraction is provided by an air shock having one end attached to platform 30 and the other end attached relative to the stationary frame of the apparatus 10. As the air shock tends to expand along its length, it returns the platform to its nonoperating position, which is substantially out of the exercise range of the gymnast. It should however be understood that other biasing return means may be included, such as counterweight or spring return means.

Adjustability

Vertical adjustment of the operating height of the spotting platform is an important part of the present invention. In practice, it has been found that at least three levels may be utilized to fit the spotter's needs, depending on which needs exists at the particular time. For example, a "high" position may be used when the spotter wishes to spot a gymnast when the gymnast is practicing moves above the vertical plane of the horizontal bar. A "low" position may also be used, to allow the spotter to provide assistance to the gymnast when conducting activities relating to lower positions relative to the high bar, such as when dismounting. The "medium" position may be used to provide assistance to the gymnast when conducting activities somewhere between the two above-referenced positions. The use of such positions is usually left up to the discretion of the spotter, who likewise tends to be the coach or assistant of the gymnast.

A jack 70 or other lifting device including a control means 72 is contemplated for use under the present invention, which allows one to adjust the vertical height of the stationary platform. In one preferred embodiment, this jack 70 is a screw type of jack, although other configurations are contemplated under the present invention. The jack may be of a hydraulic, mechanical, or other suitable configuration, but its function should be understood as providing a vertical moving function to the fixed platform during its adjustment by the control means 72.

In essence, the jack 70 is operated after the four vertical support posts are converted to their "adjustable" mode (pins removed), and the jack is operated such that the vertical height of the stationary access platform 20 can be manipulated up or down. After such manipulation, the four support posts are then converted to their "fixed" or "locked" configurations if so desired. As may be understood, as the stationary access platform 20 is vertically adjusted, so is the vertical height of the spotting platform when in its "operating" position. Therefore, it may be understood that the operating height of the spotting platform 20 may be adjusted vertically relative to the height of the horizontal bar.

Independent Support

Figure 3:
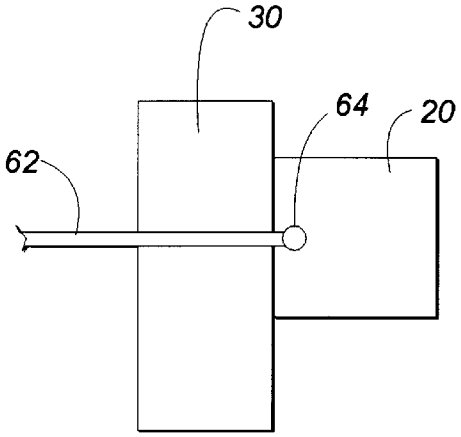
FIG. 3 is an overhead view of the apparatus 10 of the present invention, the view including one vertical post 64 and part of the horizontal bar 62 of the horizontal bar assembly used with the present invention.

As may be seen, the stationary access platform 20 includes a vertical hole therein to allow one of the vertical support posts 64 to pass therethrough as shown in FIG. 3 without significant interference. This allows the access platform 20 to be supported independently by the adjustable support posts 40, which is an important feature of one element of the present invention. As may be understood, when a gymnast is conducting routines on a horizontal bar, it is important that the horizontal bar not be disturbed by outside forces. If, for example, a spotter was standing atop a platform attached to the vertical support posts supporting the vertical support posts (such as 64), the weight of the spotter (especially if moving around rapidly on the platform to perform spotting duties) could disturb the horizontal bar by, for example, shaking it. This could be a severe disadvantage. Furthermore, supporting a spotting platform by such a single horizontal post could result in the spotting platform itself being unstable. Therefore it has been determined by the inventor that the "free standing" feature provided in one important part of one invention discussed herein.

Operation

As noted above, the apparatus 10 according to the present invention may be used by a spotter when performing spotting duties on the spotting platform 30. However, an important feature of the present invention is that is can also be used by a single individual without a spotter.

For example, a gymnast may use the spotting platform 30 alone by walking up the stairs 50, walking across the stationary access platform 20, urging the pivoting spotting platform 30 into its "operating" position, stepping upon the platform 30, and grasping the horizontal bar 62.

After grasping the horizontal bar 62, the gymnast can then step from the platform 30, removing his or her weight from it. Due to the self-retracting nature of the pivoting spotting platform 30, it then pivots out of the way of the gymnast's exercise range in order that he or she may conduct exercises without the risk of contacting the pivoting spotting platform 30. Upon completion of the exercise, the gymnast then releases the bar 62, and safely falls into the pit 100.

Therefore it may be seen that the self-retracting nature of the pivoting spotting platform 30 is an important part of the present invention, as it provides an easily-pivoted platform to access the horizontal bar 62 which pivots out of the way when weight is released therefrom. The force required to move the pivoting spotting platform 30 into its operating position is selected to be quite small, in order to allow even small children to access the platform 30.

The Advantages

Therefore, it may be seen that the present invention provides significant improvements over the prior art by providing an apparatus that allows a spotter to stand on a retractable platform while providing assistance to a gymnast. The retractable platform is pivoted about a substantially horizontal axis, which provides for the use of a pivoting platform of substantial size, which is quite stable when supporting the weight of a spotter (including sideward stability), yet nevertheless can be moved from its nonoperating position to its operating position with ease. The pivoting platform is vertically adjustable relative to the horizontal bar in the preferred embodiment, which enables a spotter to select different platform heights for different spotting techniques. Finally, the apparatus provided by the invention is stable not only due to the use of a horizontal pivoting axis, but due to the fact that it is at least primarily supported by support means other than the horizontal bar apparatus.

Conclusion

While this invention has been described in specific detail with reference to the disclosed embodiments, it will be understood that many variations and modifications may be effected within the spirit and scope of the invention as described in the appended claims.

What is claimed is:

1. A spotting assistance apparatus for use with a gymnastics horizontal bar apparatus, said spotting apparatus providing a substantially horizontal spotter support surface for supporting a spotter thereon, said spotting assistance apparatus comprising:

a stationary frame member;

a pivotable spotter support platform pivotably attached relative to said frame member and pivotable about a substantially horizontal axis relative to said stationary frame member from an operating position to a nonoperating position, said pivoting spotter support platform defining a spotter support surface being substantially horizontal and configured to support the weight of a spotter when said spotter support platform is in said operating position and being substantially vertical when in said nonoperating position; and biasing return means for returning said support platform from said operating position to said nonoperating position when said weight of said spotter is removed from said support platform.

2. The spotting assistance apparatus as claimed in claim 1, wherein said pivotable spotter support platform can be adjusted to different operating position heights.

3. The spotting assistance apparatus as claimed in claim 2, wherein said pivotable spotter support platform can be adjusted to at least two preselected heights.

4. The spotting assistance apparatus as claimed in claim 1, wherein said biasing return means comprises an air shock.

5. A spotting assistance apparatus for use with a gymnastics horizontal bar apparatus, said spotting apparatus providing a substantially horizontal spotter support surface for supporting the weight of a spotter thereon, said spotting assistance apparatus comprising:

an access platform;

a pivoting spotter support platform for providing said spotter support surface, said platform being pivotably attached relative to said access platform such that said platform is pivotably movable from an operating to a nonoperating position;

adjustable support means for supporting said access platform at varying heights relative to the horizontal bar such that the height of said spotting platform can be adjusted; and biasing return means for returning said support platform from said operating to said nonoperating position when the weight of said spotter is removed from said support platform.

6. The spotting assistance apparatus as claimed in claim 5, further comprising a stationary access platform attached to said stationary framework, said pivoting spotter support platform configured for providing access to said pivoting spotter support platform when in said operating position.

7. The spotting assistance apparatus as claimed in claim 6, further comprising a jack for moving said stationary platform up and down from different stationary positions.

8. The spotting assistance apparatus as claimed in claim 5, wherein said biasing return means comprises an air shock.

9. A spotting assistance apparatus for use with a gymnastics horizontal bar apparatus including a generally horizontal bar supported above a floor surface by a pair of vertically-oriented end support posts, said spotting assistance apparatus comprising:

a fixed access platform;

a pivoting spotter support platform for providing a substantially horizontal spotter support surface for supporting the weight of a spotter thereon said platform being pivotably attached relative to said fixed access platform from an operating position to a nonoperating position;

fixed platform support means independent of the vertical posts of the horizontal bar apparatus, said support means attached to and being configured to support said fixed platform above said floor surface; and biasing return means for returning said support platform from said operating position to said nonoperating position when the weight of the spotter is removed from said support platform.

10. The spotting assistance apparatus as claimed in claim 9, wherein said spotter support platform is pivotable along a substantially horizontal axis.

11. The spotting assistance apparatus as claimed in claim 9, wherein said spotter support platform is substantially rectangular.

12. The spotting assistance apparatus as claimed in claim 11, wherein said spotter support platform is pivotable along a substantially horizontal axis.

13. The spotting assistance apparatus as claimed in claim 9, wherein said pivotable spotter support platform can be adjusted to different operating position heights without disturbing either of the vertically-oriented end support posts.

14. The spotting assistance apparatus as claimed in claim 13, wherein said spotter support platform is pivotable along a substantially horizontal axis.

15. The apparatus as claimed in claim 9, wherein said fixed platform defines a hole through which one of said vertical posts of said horizontal bar apparatus may pass therethrough.

16. The spotting assistance apparatus as claimed in claim 15, wherein said pivotable spotter support platform can be adjusted to different operating position heights.

17. The spotting assistance apparatus as claimed in claim 16, wherein said spotter support platform is pivotable along a substantially horizontal axis.

18. The spotting assistance apparatus as claimed in claim 9, wherein the longitudinal axis of the horizontal bar lies substantially between the upper ends of the vertical posts, and wherein said spotter support platform has a first dimension along an axis substantially perpendicular to the longitudinal axis of said horizontal bar and a second dimension substantially parallel to said longitudinal axis of said horizontal bar, said first dimension being longer than said second dimension.

19. A method of providing spotting assistance to a gymnast using a horizontal bar apparatus, said method comprising the steps of:

providing a spotting assistance apparatus next to said horizontal bar apparatus, said spotting assistance apparatus including a substantially planar spotting platform pivotably movable from an operating position to a nonoperating position;

pivotably moving said platform from a substantially vertical nonoperating position to a substantially horizontal operating position; and providing spotting assistance to a gymnast with the assistance of said platform while in said operating position.

20. The method as claimed in claim 19, further comprising the step of vertically adjusting the operating height of the spotting platform.

21. The method as claimed in claim 19, wherein said spotting apparatus includes an access platform, said method further comprising the step of stepping from said access platform to said spotting platform.

22. A spotting assistance apparatus for use with a gymnastics horizontal bar apparatus including a generally horizontal bar supported above a floor surface by a pair of vertically-oriented end support posts, said spotting assistance apparatus providing a substantially horizontal spotter support surface for supporting a spotter thereon, said spotting assistance apparatus comprising:

a fixed access platform, said platform defining a hole through which one of said vertical posts of said horizontal bar apparatus may pass;

a pivoting spotter support platform for providing said spotter support surface, said platform being pivotably attached relative to said fixed access platform from an operating position to a nonoperating position; and fixed platform support means independent of said vertical posts of said horizontal bar apparatus, said support means attached to and being configured to support said fixed platform above said floor surface.

23. The spotting assistance apparatus as claimed in claim 22, wherein said pivotable spotter support platform can be adjusted to different operating position heights.

24. The spotting assistance apparatus as claimed in claim 23, wherein said spotter support platform is pivotable along a substantially horizontal axis.

25. A spotting assistance apparatus for use with a gymnastics horizontal bar apparatus itself including an elongate horizontal bar and two vertical support posts supporting the horizontal bar, the elongate horizontal bar having a longitudinal axis lying substantially along the two upper ends of the two vertical support posts, said spotting apparatus providing a substantially horizontal spotter support surface for supporting the weight of a spotter thereon, said spotting assistance apparatus comprising:

a stationary supporting framework including at least one supporting member;

a pivotable spotter support platform pivotable about a substantially horizontal axis relative to said stationary framework from an operating position to a nonoperating position, said pivoting spotter support platform defining a spotter support surface being substantially horizontal and configured to support the weight of a spotter when said spotter support platform is in said operating position, said pivoting axis of said pivotable spotter support platform being substantially perpendicular to that of the longitudinal axis of the horizontal bar; and biasing return means for returning said support platform from said operating position to said nonoperating position when the weight of the spotter is removed from said support platform.

26. The spotting assistance apparatus as claimed in claim 25, wherein said pivoting axis of said pivotable spotter support extends under the horizontal bar.

* * * * *